US008405694B2

(12) United States Patent
Hsu et al.

(10) Patent No.: US 8,405,694 B2
(45) Date of Patent: Mar. 26, 2013

(54) METHOD OF HEATING THERMAL PRINT UNIT OF DYE SUBLIMATION PRINTER

(75) Inventors: Fu-Liang Hsu, Taiching County (TW); Hui-Ting Yang, Taoyuan County (TW)

(73) Assignee: HiTi Digital, Inc., Taipei (TW)

( * ) Notice: Subject to any disclaimer, the term of this patent is extended or adjusted under 35 U.S.C. 154(b) by 320 days.

(21) Appl. No.: 12/889,415

(22) Filed: Sep. 24, 2010

(65) Prior Publication Data

US 2012/0007934 A1 Jan. 12, 2012

(30) Foreign Application Priority Data

Jul. 6, 2010 (TW) ..... 99122137 A

(51) Int. Cl.
*B41J 2/32* (2006.01)

(52) U.S. Cl. ..... 347/171

(58) Field of Classification Search ..... 347/171, 347/180–187, 191, 194–196
See application file for complete search history.

(56) References Cited

U.S. PATENT DOCUMENTS 5,581,294 A * 12/1996 Fujii et al. ..... 347/183
7,379,082 B2 * 5/2008 Jo et al. ..... 347/186

FOREIGN PATENT DOCUMENTS

TW I245707 12/2005
TW 200817199 4/2008

* cited by examiner

*Primary Examiner* — Kristal Feggins
(74) *Attorney, Agent, or Firm* — Winston Hsu; Scott Margo

(57) ABSTRACT

While a dye sublimation printer prints data on a sheet, a thermal print unit is heated with a plurality of discrete heat times and a plurality of discrete cooling times. Therefore, under the condition that the thermal print unit accurately prints a target color level, degradation of printing performance caused by continuous heating of the thermal print unit is prevented.

3 Claims, 1 Drawing Sheet

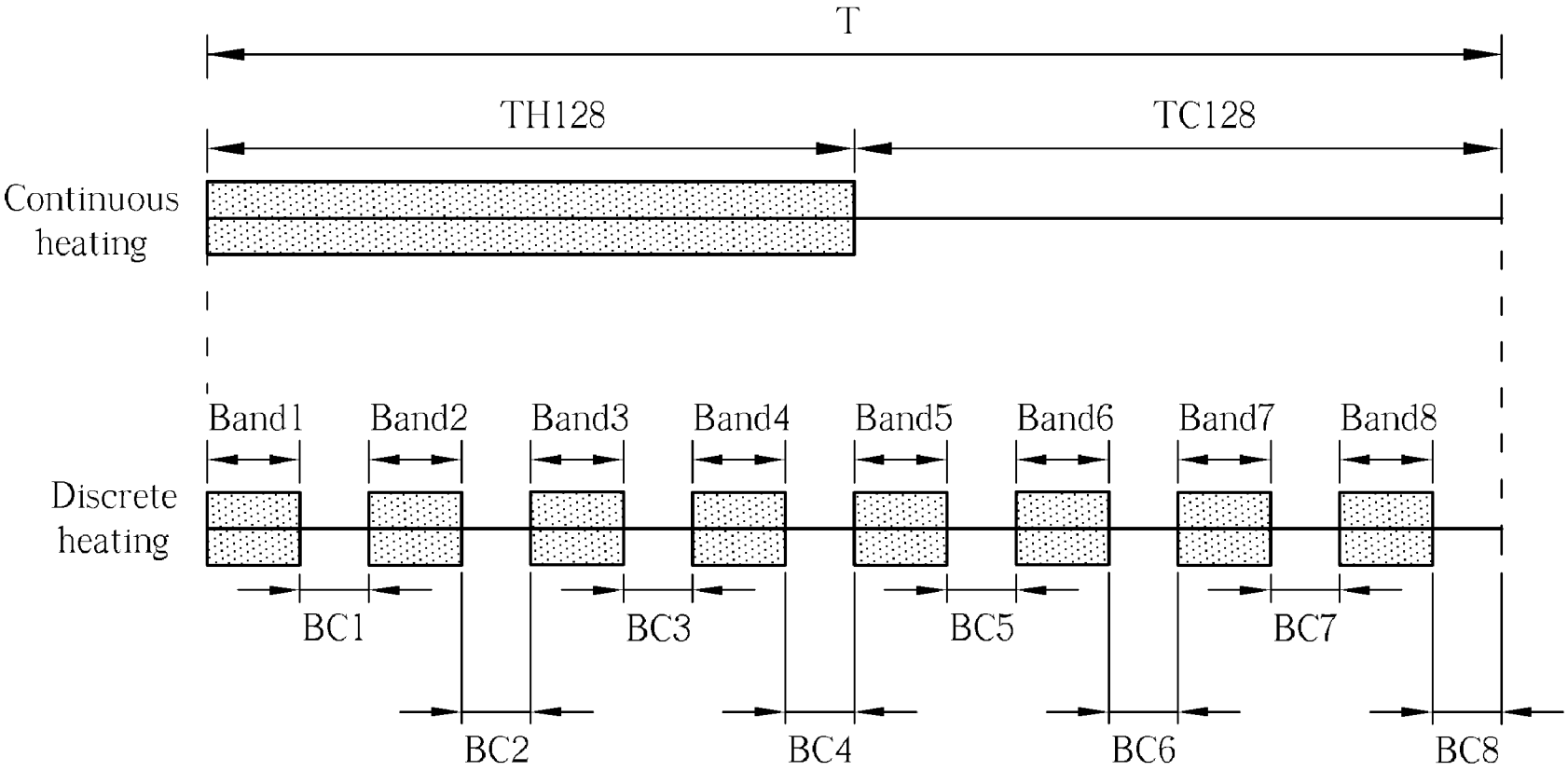
T
TC128
TH128
Continuous heating
Discrete heating
Band1
Band2
Band3
Band4
Band5
Band6
Band7
Band8
BC1
BC2
BC3
BC4
BC5
BC6
BC7
BC8

METHOD OF HEATING THERMAL PRINT UNIT OF DYE SUBLIMATION PRINTER

BACKGROUND OF THE INVENTION

1. Field of the Invention

The present invention discloses a method of heating a thermal print unit of a dye sublimation printer, and more particularly, to a method of heating a thermal print unit by uniformly distributing a heating duration of the thermal print unit for preventing the thermal print unit from cooling for an overlong duration.

2. Description of the Prior Art

One conventional dye sublimation printer includes a thermal print module, which includes at least one thermal print unit arranged in a row. While the conventional dye sublimation printer is used for printing data on a sheet, the data is printed row-by-row on the sheet by moving the thermal print module row-by-row, where dots on a single row of the sheet are simultaneously and respectively touched and printed by the at least one thermal print unit of the thermal print module. For brevity of description, the following description will be based on a single thermal print unit of the thermal print module, instead of all of the thermal print units of said thermal print module.

While one conventional dye sublimation printer prints data on a sheet, a thermal print unit is gradually heated from a cooling state, which corresponds to a lowest color level, until a certain dot of the sheet touched by the thermal print unit is changed by its color level to reach a target color level. Then, the thermal print unit is ceased heating and then gradually cooled down, until the thermal print module is moved to a next row on the sheet, then the thermal print unit is gradually heated again to another target color level and is gradually cooled down again. Note that thermal print units on the thermal print module may acquire different and independent target levels while the thermal print module prints a single row.

However, the heating on the thermal print unit mentioned above may cause insufficiency of heating on the certain dot of the sheet while the thermal print unit is gradually cooled down, in comparison to the heating while the thermal print unit is gradually heated; and as a result, the heating on the certain dot by the thermal print unit is not uniform as well. While observing the unbalanced heating on the heated sheet by the thermal print module with the aid of naked eyes, the phenomenon could be easily observed so that the printing performance of the dye sublimation printer is apparently degraded.

SUMMARY OF THE INVENTION

The claimed invention discloses a method of heating a thermal print unit of a dye sublimation printer. The method comprises heating a thermal print unit to a target color level within a predetermined time, by heating the thermal print unit with a plurality of first discrete times and cooling the thermal print unit with a plurality of second discrete times, so that the thermal print unit prints data with the target color level, while the thermal print unit is to be heated to the target color level within the predetermined time. The predetermined time equals to a required time for heating the thermal print unit from a lowest color level to a highest color level.

These and other objectives of the present invention will no doubt become obvious to those of ordinary skill in the art after reading the following detailed description of the preferred embodiment that is illustrated in the various FIGURES and drawings.

BRIEF DESCRIPTION OF THE DRAWINGS

FIGURE illustrates a timing diagram of comparing a first timing of gradually heating the thermal print unit in the prior art with a second timing of discretely heating said thermal print unit according to an embodiment of the present invention.

DETAILED DESCRIPTION

For neutralizing the degradation of the printing performance of a conventional dye sublimation printer, where the degradation caused by unbalanced heating on the thermal print unit, the present invention discloses a method of heating the thermal print unit of the dye sublimation printer. Similarly, for brevity of description, the following descriptions are primarily based on a single thermal print unit of the thermal print module, instead of describing based on all thermal print units of said thermal print module. In the disclosed method, the thermal print unit is not gradually heated and then gradually cooled down, instead, the thermal print unit is heated in a plurality of first discrete times and is cooled down in a plurality of second discrete times, where a total of the plurality of first discrete times is sufficient to heat the thermal print unit till a target color level. Therefore, heating on the sheet by the thermal print unit is continuously maintained above a certain degree, such as a certain temperature, without unbalanced heating on the certain dot of the sheet.

Please refer to FIGURE, which illustrates a timing diagram of comparing a first timing of gradually heating the thermal print unit in the prior art with a second timing of discretely heating said thermal print unit according to an embodiment of the present invention. As shown in FIGURE, assume that an available color level of the dye sublimation printer ranges from 0 to 256, and assume that a target color level is 128; therefore, while heating the thermal print unit in the conventional and gradual manner so as to heat the certain dot on the sheet, the thermal print unit is gradually heated with a heating time TH128, and is then gradually cooled down with a cooling time TC128, where a sum of the heating time TH128 and the cooling time TC128 equals to a printing time T, which indicates a total time of heating the thermal print unit from 0, which may be indicated as a lowest color level, to 256, which may be indicated as a highest color level, while printing the certain dot on the sheet. On the contrary, in the disclosed method of heating the thermal print unit of the present invention, the heating time TH128 is segmented into eight segments of heating times Band1, Band2, Band3, Band4, Band5, Band6, Band1, and Band8, all of which may be equal in length or not; moreover, each of the heating times Band1-Band8 is followed by a corresponding cooling time, i.e., cooling times BC1, BC2, BC3, BC4, BC5, BC6, BC7, and BC8, as shown in FIGURE, where a total length of the cooling times equals to the cooling time TC 128. Therefore, the target color level, i.e., 128, can be reached by heating the thermal print unit in a repeated manner, i.e., repeatedly heating the thermal print unit with a discrete heating time followed by a discrete cooling time so that the thermal print unit is heated by a plurality of discrete heating time and a plurality of cooling time. As a result, the printing performance of the dye sublimation printer is prevented from being degraded since the sheet is not continuously by the thermal print unit in the present invention.

As described before, the heating times Band1-Band8 may not be entirely equal in length, and in a preferred embodiment of the present invention, the lengths of the heating times Band1-Band8 may be determined according to a smallest unit heating time and a color level difference between the target color level and a lowest color level for the dye sublimation printer. FIGURE and the above-mentioned exemplary values are used for describing how the lengths of the heating times Band1-Band8 are determined. The smallest unit heating time is determined as follows:

$$S = \frac{T}{K}; \tag{1}$$

where S indicates the smallest unit heating time, K indicates a color level difference between a lowest color level and a highest color level for the dye sublimation printer. For example, when the highest color level acquires a value 256, and the lowest color level acquires a value 0, then the color level difference K acquires a value (256−0)=256. The following equations are used for determining the lengths of the heating times Band1-Band8:

$$\left\lfloor \frac{C}{N} \right\rfloor = Q,\ N > 1; \tag{2}$$

$$C \% N = R,\ 0 \le R < N; \tag{3}$$

$$\mathrm{Band}_i = S * (Q + r),\ 1 \le i \le N; \tag{4}$$

where C indicates the color difference between the target color level and the lowest color level, for example, 0; N indicates an amount of the heating times Band1-Band8 so that N acquires the value 8 in said example; however, the value of the amount N may be optional in other embodiments of the present invention according to various requirements. Q indicates a quotient derived by dividing the color difference C by the amount N, and R indicates a residue derived by dividing the color difference C by the amount N. r indicates a parameter acquiring a value of 0 or 1.

Assume that the target color level acquires a value 134, according to the above-assumed values, the color level difference C equals to 134, the quotient Q equals to $$\left\lfloor \frac{134}{8} \right\rfloor = 16,$$

the residue R equals to 134% 8=6. According to the preferred embodiment of the present invention, for balancing the lengths of the heating times Band1-Band8 as uniform as possible without missing the target color level, i.e., 134, any six of the heating times Band1-Band8 are assigned with the parameter r having the value 1, whereas the remaining two of said heating times Band1-Band8 are assigned with the parameter r having the value 0, where a number of the six of the heating times Band1-Band8 is determined according to the value of the residue R, which acquires the value 6. Therefore, lengths of the chosen six from the heating times Band1-Band8 all equal to S*(Q+r)=S*(Q+1)=S*(16+1)=17S, and lengths of the remaining two from the heating times Band1-Band8 equal to S*(Q+r)=S*(Q+0)=S*(16+0)=16S. Besides, while the value of the color level difference is divisible by the value of the amount N, i.e., while the value of the residue R is zero, then parameters r for all of the heating times Band1-Band8 acquire values of zero, so that the lengths of the heating times Band1-Band8 are all equal.

As can be observed from the above examples, the lengths of the heating times Band1-Band8 may not be entirely equal, however, length differences between any two of the heating times Band1-Band8 cannot exceed one smallest unit heating time S. Therefore, the thermal print unit is still capable of uniformly heating the certain dot on the sheet, or even the entire sheet, without missing the target color level.

The present invention discloses a method of heating a thermal print unit of a dye sublimation printer. In the disclosed method, the thermal print unit is heated with a plurality of discrete heating time and a plurality of discrete cooling time, so as to prevent degradation of printing performance of a dye sublimation printer caused by continuously heating and cooling the thermal print unit.

Those skilled in the art will readily observe that numerous modifications and alterations of the device and method may be made while retaining the teachings of the invention.

What is claimed is:

1. A method of heating a thermal print unit of a dye sublimation printer, comprising:

generating a shortest unit heating time, by dividing a predetermined time by a first color level difference between a highest color level and a lowest color level;

determining a length of each of a plurality of first discrete times according to the shortest unit heating time and a second color level difference between the lowest color level and a target color level; and heating a thermal print unit to the target color level within the predetermined time, by heating the thermal print unit with the plurality of first discrete times and cooling the thermal print unit with a plurality of second discrete times, so that the thermal print unit prints data with the target color level, while the thermal print unit is to be heated to the target color level within the predetermined time;

wherein the plurality of first discrete times are not all equal, and the plurality of second discrete times are not all equal; and wherein the predetermined time equals to a required time for heating the thermal print unit from the lowest color level to the highest color level.

2. The method of claim 1, wherein determining the length of each of the plurality of first discrete times according to the shortest unit heating time and the second color level difference comprises:

determining the length of each of the plurality of first discrete times according to:

$$\mathrm{Band}_i = S*(Q+r);$$

while S indicates the smallest heating time, Q indicates a quotient derived by dividing the second color level difference by a number of the plurality of first discrete times, $\mathrm{Band}_i$ indicates a length of an i-th time among the plurality of first discrete times, and r indicates a parameter, wherein a value of the parameter r is 0 or 1.

3. The method of claim 2, wherein the plurality of first discrete time comprise a plurality of first heating times and a plurality of second heating times, a length of each of the plurality of first heating times equals to S*(Q+1), a length of each of the plurality of second heating times equals to S*Q, and a number of the plurality of first heating times equals to a residue generated by dividing the second color level difference by the number of the plurality of first discrete times.

* * * * *